United States Patent [19]

Kenney

[11] Patent Number: 4,461,328

[45] Date of Patent: Jul. 24, 1984

[54] PIPETTE DEVICE

[75] Inventor: James W. Kenney, West Chester, Pa.

[73] Assignee: Drummond Scientific Company, Broomall, Pa.

[21] Appl. No.: 385,018

[22] Filed: Jun. 4, 1982

[51] Int. Cl.[3] ..... B65B 3/14

[52] U.S. Cl. ..... 141/67; 141/286; 55/159; 73/864.02; 422/100; 435/287

[58] Field of Search ..... 141/1, 2, 3–12, 141/18–29, 65–68, 285–310, 234–248; 435/287, 311; 422/100; 73/864.02; 55/159

[56] References Cited

U.S. PATENT DOCUMENTS 3,741,732 6/1973 Stanfield .

3,864,979 2/1975 Ayres ..... 55/159

3,921,460 11/1975 Schmidlin ..... 73/864.02

4,267,729 5/1981 Eddelman et al. ..... 73/864.02

*Primary Examiner*—Houston S. Bell, Jr.

*Attorney, Agent, or Firm*—John F. A. Earley

[57] ABSTRACT

A pipette device comprises one or more pipette tubes. Hydrophobic filter paper secured to each tube limits the upward movement of an aqueous liquid in each tube to provide for a predetermined amount of liquid in each tube. The device can be adapted to be connected to a manifold for alternately applying a vacuum and pressure to the pipette tubes through the filter paper. Alternatively it may have, as an integral part thereof, a manifold for the same purpose.

13 Claims, 10 Drawing Figures

PIPETTE DEVICE

TECHNICAL FIELD

This invention is in the field of fluid handling.

BACKGROUND OF THE PRIOR ART

Single and multiple pipetting devices are well known to the art. Typical are U.S. Pat. Nos. 3,430,628, 3,568,735, 3,572,552, 3,261,208, 3,807,235, 3,982,438 and 4,158,035. The principal problem in connection particularly with multiple pipettes relates to accurately controlling the desired amount of fluid to be aspirated into the pipette tubes and then discharged. Cost, of course, is another major factor. The favored solution in the prior art is to employ multiple pipettes with plungers. Such devices of necessity have a column of air between each plunger and the liquid when the liquid has been inspirated. This necessitates calibrating the device for each aqueous liquid used. Further, they involve making costly parts and are expensive to assemble.

It is also known to use a rubber diaphragm which is displaced within cavities of a predetermined dimension to provide a negative pressure for the aspiration of a liquid and then a positive pressure for its discharge. The rubber diaphragm devices have essentially the same deficiencies as the plunger devices.

Hydrophobic filters which freely pass air or other gases but require an elevated pressure for the introduction of an aqueous liquid into and through the filter are known to the art for use, for example, in filtering air or permitting air to escape from a liquid mass.

In accordance with this invention, the problems of the prior art have been solved by the employment of a hydrophobic filter to limit the amount of liquid which can be drawn into the pipette tubes while at the same time permitting the passage of air or other gas for the creation of the necessary negative pressure for aspiration and positive pressure for discharge. The invention is superior because it eliminates the air column and any need for calibration since the total volume of the pipette chamber measures the quantity of liquid inspirated. Also, costly parts have been eliminated.

BRIEF SUMMARY OF INVENTION

A pipette device comprises one or more pipette tubes. Hydrophobic filter paper secured to each tube limits the upward movement of an aqueous liquid in each tube to provide for a predetermined amount of liquid in each tube. The device can be adapted to be connected to a manifold for alternately applying a vacuum and pressure to the pipette tubes through the filter paper. Alternatively it may have, as an integral part thereof, a manifold for the same purpose.

DETAILED DESCRIPTION

Figure 1:
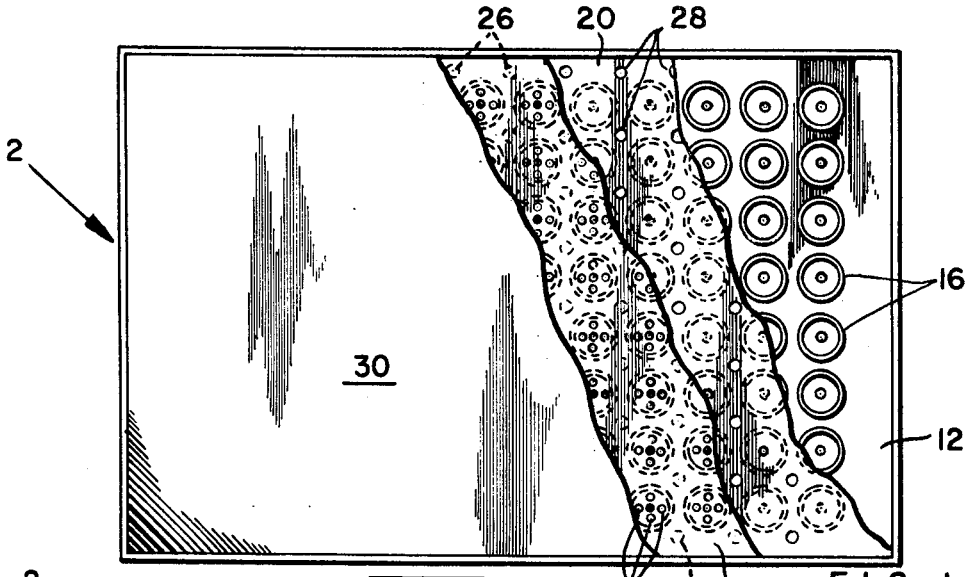
FIG. 1 is a plan view of a pipette device in accordance with the invention.
Figure 3:
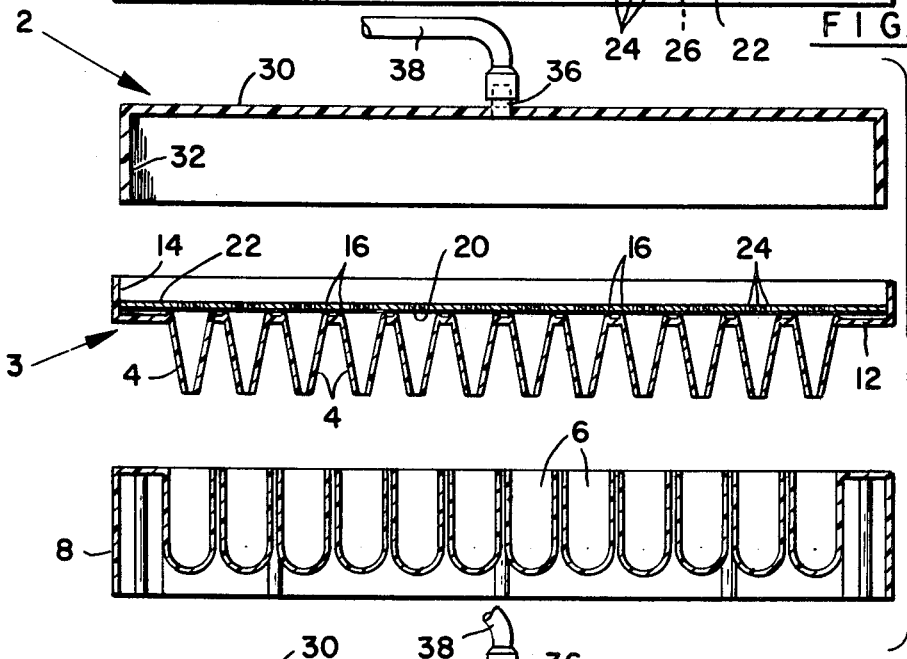
FIG. 3 is an exploded view of the devices of FIG. 2.
Figure 2:
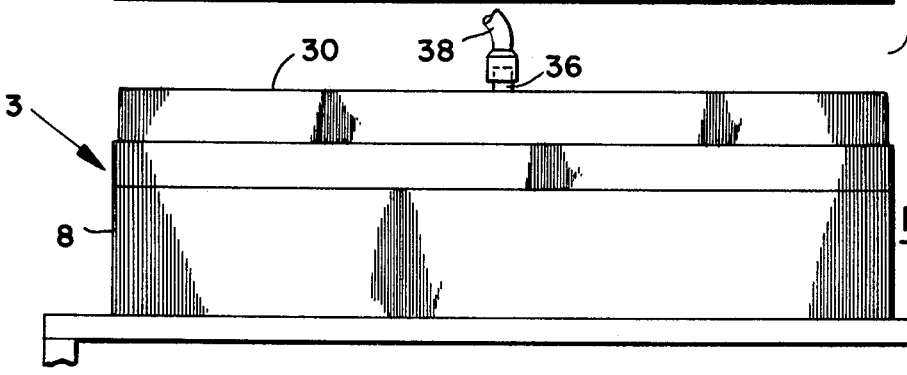
FIG. 2 is a front elevation of the device of FIG. 1 seated on a well tray.

A pipette device 2 in accordance with the invention has a pipette tray 3 with a plurality of conically shaped pipette tubes 4 adapted to register with wells 6, for example, culture wells, in a conventional well tray 8.

The upper end of each tube 4 is integral with a substantially rigid plate 12 which has an upstanding peripheral flange 14. Adjacent the upper end of each pipette tube 4 is a circular bead 16 rounded off at its top.

Overlying plate 12 is a hydrophobic filter sheet 20. Hydrophobic filter sheets are well known to the art. Typical are plastic filter sheets having discrete uniform passages (pores) through the sheet which act as fine uniform capillaries. Typical plastics used to make the sheets are polytetrafluoroethylene, polyvinyl chloride, and halogenated fluoroalkanes such as polyvinylidene fluoride. Advantageously a pore size of from about 0.1 to about 1.2 microns will be used.

Figure 4:
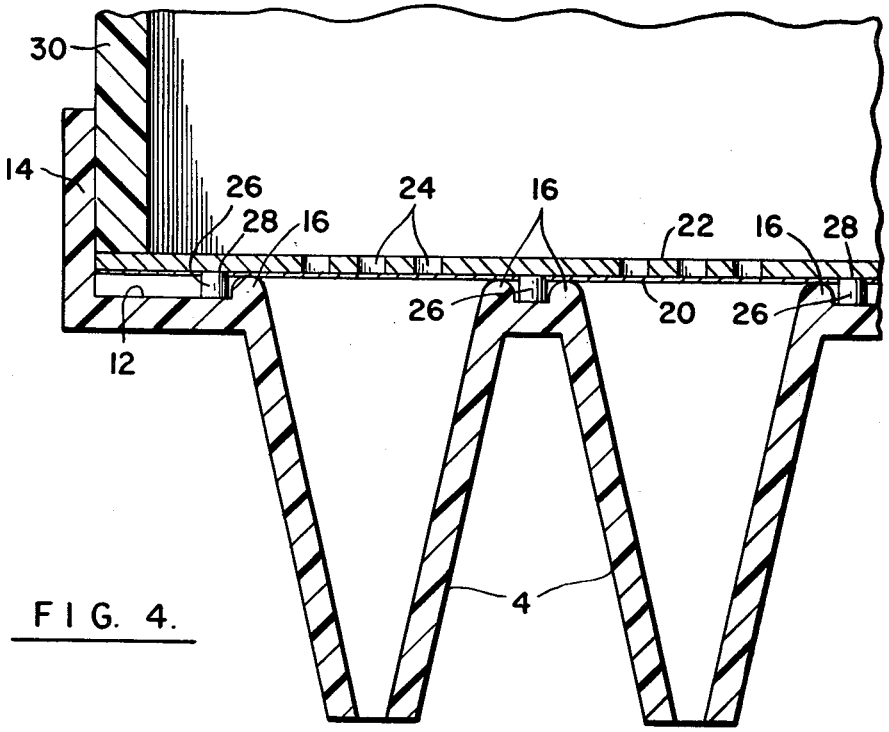
FIG. 4 is an enlarged view, partially broken away, of a portion of the device of FIG. 1.

Overlying filter sheet 20 is a substantially rigid plate 22 having openings 24 overlying the pipette tubes 4 which are substantially smaller in diameter than the upper ends of the pipette tubes 4 (FIG. 4). The size of openings 24 is not critical so long as they permit the passage of a gas.

Plate 22 has depending bosses 26 which pass through openings 28 in the filter sheet 20 and are welded, for example sonically, to plate 12 to insure that plate 22 will hold filter sheet 20 tightly against each bead 16.

A top plate 30 has a depending peripheral flange 32 in contact with the outside of peripheral flange 14 and resting against plate 22. Plate 30 is held in place by virtue of flange 32 being sonically welded to flange 14. Other conventional securing means may be employed for the securing discussed above, for example, an adhesive, screws or other mechanical securing means. Conveniently the device as described above will be made of a plastic so that sonic welding can be employed. Suitable plastics are, for example, polycarbonates, acrylics such as methyl methacrylate, polyethylene, cellulose acetate butyrate. Other materials such as glass may, of course, be used also.

A connection fitting 36 is mounted through plate 30 and is adapted to be secured to a flexible hose 38. Hose 38 may be used to apply mouth suction or pressure or may be connected to a conventional vacuum-pressure device such as the one typically used with pipetting devices described below.

Operation

In operation, the device 2 is positioned with pipette tubes inserted into wells 6 containing an aqueous liquid (not shown). A negative pressure is exerted, for example, by sucking in on tube 38 which causes the aqueous liquid contained in wells 6 to be drawn into pipette tubes 4 until the liquid reaches the hydrophobic filter sheet 20 which stops the upward movement of liquid in tubes 4. At this juncture, each pipette tube 4 is completely full, containing an exact predetermined amount of liquid. The device 2 is then removed from tray 8 and is moved to, for example, another tray 8 into which it is desired to discharge the liquid contained in pipette tubes 4. Tubes 4 are aligned with the wells into which their contents are to be discharged and a positive pressure, for example, by mouth is applied to tube 38 causing air to pass through the filter sheet 20 and discharge the contained liquid.

It will be understood that the vacuum applied will be consistent with the pore size of the hydrophobic filter sheet so that the pressure differential between the atmospheric pressure and the pressure in the vacuum chamber above the filter sheet will be insufficient to cause the aqueous liquid to enter the filter sheet. This presents no problem since the pressure differential can be small for satisfactory operation compared to the pressure differential necessary to cause the aqueous liquid to enter the filter sheet of a given pore size. Thus an operator's lung suction providing a pressure differential of about 3 p.s.i. is more than adequate for operation, whereas it takes a pressure differential of about 19 p.s.i. to cause liquid to enter the pores of a typical hydrophobic filter sheet having a pore size of 0.2 microns.

Figure 5:
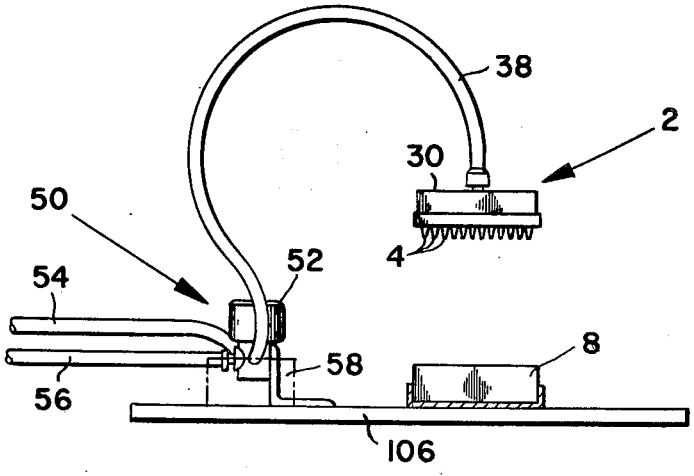
FIG. 5 is a front elevation of the device of FIG. 1 connected to a vacuum-pressure device.
Figure 6:
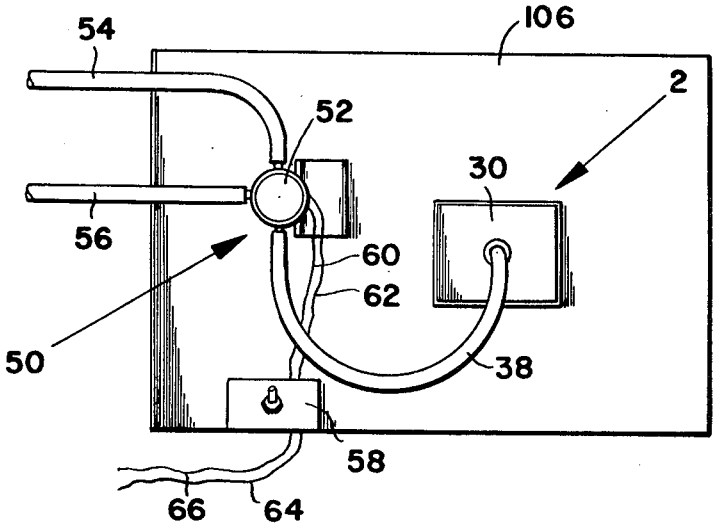
FIG. 6 is a plan view of the devices in FIG. 5.

As shown in FIGS. 5 and 6, flexible hose 38 may be connected to a conventional prior art vacuum-pressure device 50 which has a two-way solenoid valve 52 which can connect either a pressure line 54 or a vacuum line 56 to flexible hose 38. The position of valve 52 is controlled by a toggle switch 58 which is connected to the solenoid valve 52 by lines 60 and 62 and in turn is connected to a source of power by lines 64 and 66.

Figure 7:
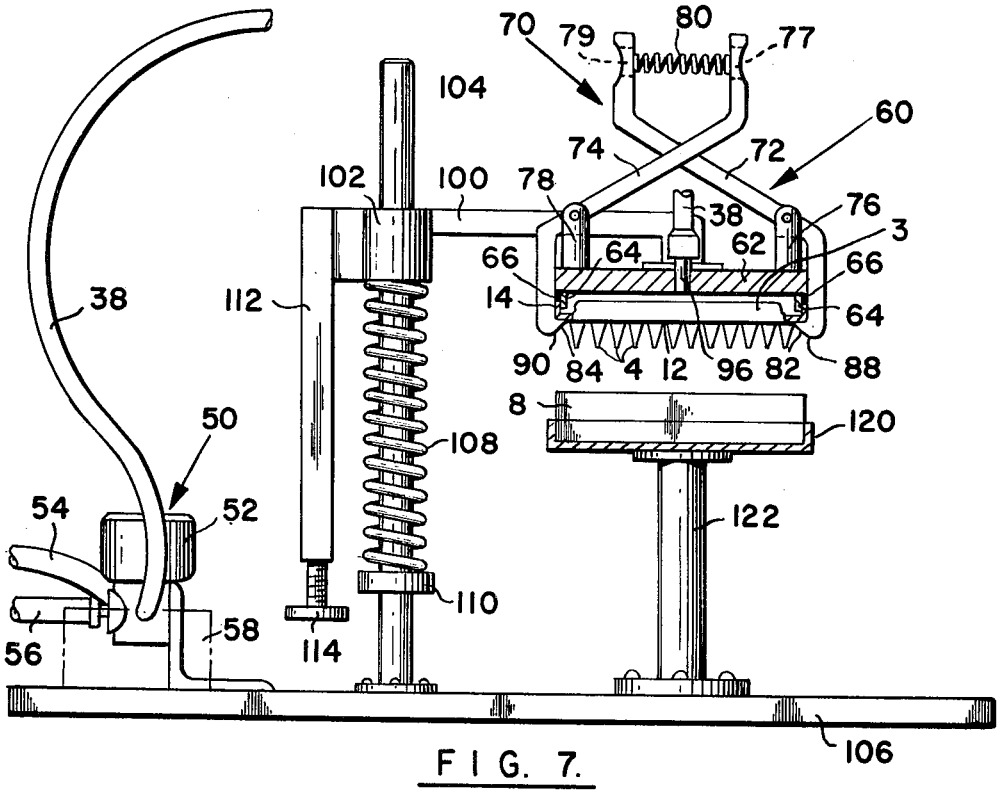
FIG. 7 is a front elevation of a modified pipette device of the invention.
Figure 8:
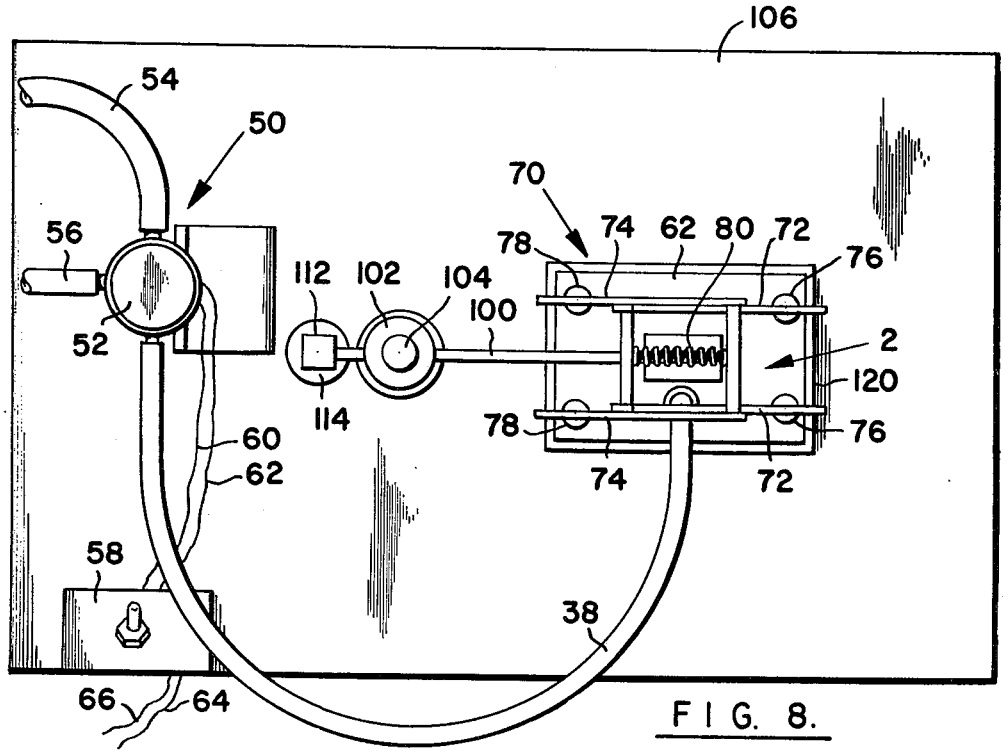
FIG. 8 is a plan view of the device of FIG. 7.

Referring now to FIGS. 7 and 8, the tray 3 of pipette device 2 may be employed without top plate 30 by using it in conjunction with a permanent manifold device 60. Device 60 has a plate 62 from which depends a peripheral guide flange 64, the exterior of which is adapted to be engaged by flange 14 of pipette tray 3. On the exterior of flange 64 and secured to plate 62 is a peripheral strip 66 of sealing material such as sponge rubber which is adapted to be engaged by flange 14 when it is held in position by tongs 70.

Tongs 70 have pairs of arms 72, 72 and 74, 74 pivotally mounted on brackets 76 and 78 respectively, connected by bars 77 and 79 respectively and having their upper ends biased together by an extension spring 80 anchored to bars 77 and 79. Each arm 72 has an inwardly projecting portion 82 and each arm 74 has an inwardly projecting portion 84 adapted to engage the bottom of plate 12 of pipette tray 3 to secure tray 3 to plate 62 with flange 14 in engagement with sealing strip 66. Portions 82 and 84 have cam faces 88 and 90 respectively providing for the camming apart of these portions of the tongs when the tray 3 is moved upwardly. Tray 3 is readily released by moving the upper portions of levers 72 and 74 apart against the bias of extension spring 80. A fitting 96 is inserted through plate 62 and is adapted to be connected, for example, a flexible hose 38 which in turn is connected to the vacuum-pressure device 50.

Plate 62 is mounted on a bracket 100 secured to a bearing member 102 which is slidably mounted on a standard 104 secured to a base 106. Bearing member 102 is biased upwardly by a compression spring 108 which abuts against bearing member 102 and against a collar 110 fixedly secured to standard 104. A member 112 depends from bearing member 102 and is threadably connected to a stop member 114 which limits the downward movement of bearing member 102.

Well tray 8 is mounted in a receptacle 120 mounted on a standard 122 secured to base 106 to position well tray 8 precisely for registry with vacuum-pressure device 60 when it is lowered against the bias of spring 108 to enter the pipettes 4 into the wells 6 of well tray 8 for the purpose of inspiration of liquid from well tray 8 or the deposit of liquid into well tray 8.

Figure 9:
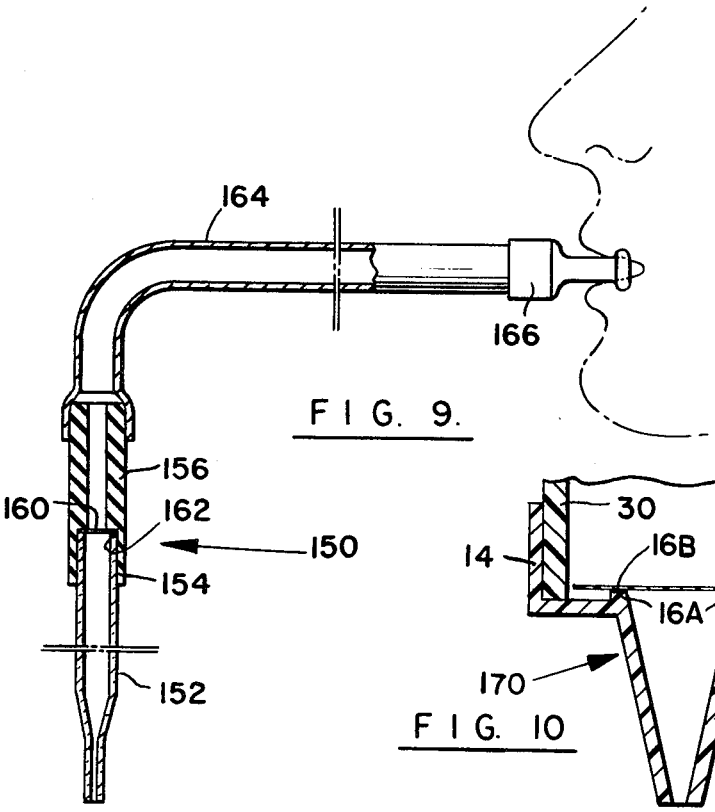
FIG. 9 is a side elevation of a single pipette device of the invention.

In FIG. 9 a single pipette 150 in accordance with the invention is shown. A pipette tube 152 is mounted in an enlarged inner diameter portion 154 of a hollow resilient fitting 156 of, for example, rubber. A hydrophobic filter sheet 160 is securely held between the top of tube 152 and step 162 in fitting 156. A flexible tube 164 is connected to fitting 156 and to a mouthpiece 166. An aqueous liquid is readily inspirated into pipette tube by mouth suction until it reaches the hydrophobic filter sheet 160 and then discharged by mouth pressure. Here again a precise amount of fluid will be inspirated into the pipette tube 152 when it is full.

Figure 10:
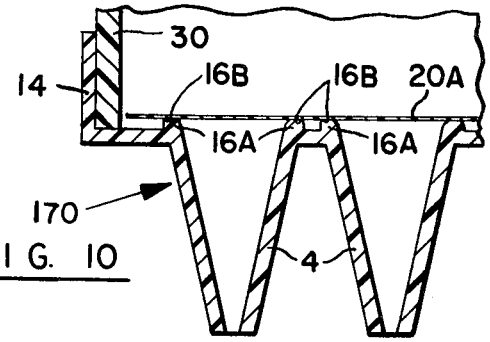
FIG. 10 is a view, partially broken away, of a pipetting device in accordance with the invention.

As illustrated in FIG. 10, a pipette tray 170 differs slightly from pipette tray 3 in that it has beads 16A adjacent the upper ends of tubes 4 which have flat tops 16B. A sheet of filter paper 20A is bonded to the tops 16B of beads 16A using bonding techniques known to the art, for example, by an adhesive or by heat welding.

It will be understood that the above-described embodiments are illustrative and are not intended to be limited.

I claim:

1. A multiple pipette device comprising:

a plurality of pipette tubes having upper and lower ends, means for holding the pipette tubes together, and a hydrophobic filter secured to the top of each pipette tube to limit the upward movement of an aqueous liquid in the tube to provide for filling the tube with a predetermined amount of aqueous liquid while permitting the passage of a gas through the filter.

2. A multiple pipette device in accordance with claim 1 having means for connecting the upper ends of the pipette tubes to a source of vacuum or a source of gas pressure.

3. A multiple pipette device comprising:

a pipette tray having a plurality of integral depending pipette tubes, and a hydrophobic filter sheet overlying and secured to the tops of the plurality of pipette tubes to limit the upward movement of an aqueous liquid in the tubes to provide for filling the tubes with a predetermined amount of aqueous liquid while permitting the passage of a gas through the tubes and the filter sheet.

4. A pipette device in accordance with claim 3 in which the tray is integral with a manifold.

5. A pipette device in accordance with claim 3 in which an upstanding bead on the tray surrounds the top of each pipette tube and means to secure the filter sheet to the beads.

6. A pipette device in accordance with claim 5 in which a manifold is integral with the pipette tray.

7. A multiple pipette device comprising:

a plurality of pipette tubes having upper and lower ends, means for holding the pipette tubes together, a hydrophobic filter secured to the top of each pipette tube to limit the upward movement of an aqueous liquid in the tube to provide for filling the tube with a predetermined amount of aqueous liquid while permitting the passage of a gas through the filter, and means forming a manifold above said pipette tubes and in fluid communication with said tubes, said manifold being adapted to be connected to a source of vacuum and a source of pressure.

8. The pipette device of claim 4, including means for applying positive and negative pressure to said manifold.

9. The pipette device of claim 3, including a substantially rigid plate overlying the hydrophobic filter sheet having openings that are smaller in diameter than the upper ends of the pipette tubes.

10. The pipette device of claim 9, said plate having depending bosses that pass through openings in the filter sheet and are welded to the pipette tray thereby insuring that said plate holds the hydrophobic filter sheet tightly against the upper ends of the pipette tubes.

11. The pipette device of claim 10, including an upstanding bead on the tray surrounding the top of each pipette tube whereby the hydrophobic filter sheet is held tightly against each bead by the rigid plate that is overlying the hydrophobic filter sheet and is welded to the pipette tray.

12. A pipette device of claim 3, including a manifold comprising a top plate having a depending peripheral flange in contact with the outer edge of the pipette tray, a connection fitting mounted through the top plate, and means to secure the connection fitting to a flexible hose.

13. The pipette device of claim 12, including means for applying positive and negative pressure to the manifold.

* * * * *